United States Patent [19]

Nessi

[11] 4,311,032

[45] Jan. 19, 1982

[54] METHOD AND APPARATUS FOR ROLLING SEAMLESS TUBES WITH A RESTRAINED MANDREL

[75] Inventor: Aurindo Nessi, Albate, Italy

[73] Assignee: Innocenti Santeustacchio S.p.A., Brescia, Italy

[21] Appl. No.: 113,276

[22] Filed: Jan. 18, 1980

[30] Foreign Application Priority Data

Feb. 7, 1979 [IT] Italy ..... 19980 A/79

[51] Int. Cl.[3] ..... B21B 17/04

[52] U.S. Cl. ..... 72/208; 72/252

[58] Field of Search ..... 72/208, 209, 214, 250, 72/252, 251

[56] References Cited

U.S. PATENT DOCUMENTS 2,783,666 3/1957 McLag ..... 72/252 X 4,186,585 2/1980 Passoni et al. ..... 72/208

FOREIGN PATENT DOCUMENTS 140783 1/1961 U.S.S.R. ..... 72/208

248615 7/1969 U.S.S.R. ..... 72/208

*Primary Examiner*—Milton S. Mehr

*Attorney, Agent, or Firm*—Birch, Stewart, Kolasch & Birch

[57] ABSTRACT

Rolling mills for rolling seamless tubes from axially pierced blanks or billets using a restrained mandrel have suffered from a high dead time in the oprating cycle due to the necessity of returning a mandrel-restraining cross-piece or other member from its final position back to its initial position through the roll stands before beginning the positioning of the next billet to be rolled. This invention overcomes the above-mentioned problem by providing an elongate axially extending recess in the mandre-restraining crosspiece which allows the next billet to be positioned before the end of the preceding rolling operation. The mandrel-restraining crosspiece is ready to be connected up immediately to the next billet when the mandrel-restraining crosspiece has returned to its initial working position, by enabling the crosspiece to pass over the billet which goes through the recess. Retractable positive acting mechanical stops project into the recess, when advanced, to connect up the mandrel for a rolling cycle to commence.

6 Claims, 8 Drawing Figures

METHOD AND APPARATUS FOR ROLLING SEAMLESS TUBES WITH A RESTRAINED MANDREL

BACKGROUND OF THE INVENTION

The present invention relates to a method of operating a continuous rolling mill of the type having a restrained mandrel, for the production of seamless tubes starting from axially pierced billets.

The known technique of forming seamless tubes by rolling billets on a restrained mandrel comprises the steps of first introducing an axially pierced blank or billet onto a mandrel, locating the mandrel/billet unit at the input of the rolling mill and positioning it on the rolling axis of the mill, and then introducing the said unit into the rolling mill whereupon it traverses the successive roll stands with the velocity of displacement of the mandrel being controlled by means of devices and/or apparatus for restraining it.

For the performance of this known technique, continuous rolling mills are equipped, near the usual input roller conveyor which is intended to support and guide the mandrel/billet unit on its way into the rolling mill, with, for example, a restraining crosspiece, which is movable parallel to the rolling axis of the mill at a controlled rate determined by motors for the purpose of controlling the movement of the mandrel. At the commencement of each working cycle this crosspiece is stopped at a predetermined position spaced from the input of the rolling mill by a distance at least equal to the length of the mandrel, so that there is available on the input roller conveyor a space sufficient to receive a mandrel/billet unit. After such a mandrel/billet unit has been positioned on the said roller conveyor the extreme rear end of the mandrel is rigidly locked into a suitable coupling formed in or on the crosspiece. The crosspiece is then driven to advance by the said motors and the mandrel/billet unit is pushed thereby into the rolling mill and can advance through the roll stands of the rolling mill with the mandrel being restrained to move at a rate determined by the rate of advance of the crosspiece, whereby to effect the desired rolling of the billet to form a tube.

At the end of the rolling stage, the operating cycle of the rolling mill can be completed in one of two separate known techniques; a first of these requires stopping of the crosspiece and the mandrel, releasing of the now rolled tube from the mandrel and the return of the mandrel and the crosspiece through the entire succession of roll stands, on the rolling axis, until the crosspiece is back in the initial position. At this point the mandrel is released from the crosspiece and removed from the roller conveyor and a new mandrel/billet unit is then positioned on the roller conveyor for the next rolling operation.

The greatest disadvantage of this technique lies in the considerable amount of dead time between successive rollings. In fact, before being able to begin the rolling of a billet after the preceding billet has been rolled it is necessary to wait for the whole of the time required for the following six operations:

(1) release of the mandrel from the previously rolled tube, (2) return of the mandrel and crosspiece to the initial position, (3) release of the mandrel from the crosspiece, (4) removal of the mandrel from the rolling axis, (5) positioning of the new mandrel/billet unit on the rolling axis, and (6) locking of the mandrel of this new unit to the movement controlling crosspiece. Because of this considerable dead time, the rate of production of seamless tubes using this technique is decidedly, and disadvantageously, slower than the potential production capacity of the rolling mill itself.

The second technique, on the other hand, requires that at the end of the rolling, the mandrel is released from the restraining crosspiece and the mandrel/rolled tube unit removed from the rolling mill to a mandrel-releasing station. Having removed this unit from the crosspiece this latter is returned to the initial position back along the rolling axis. In this technique, in addition to the inconvenience of still having to wait a certain time, that is the time required for the return of the crosspiece to the initial position and the locking onto it of a new mandrel/billet unit, there is the further disadvantage of the difficulty of releasing the mandrel/rolled tube unit at exactly the right moment at the end of the rolling.

OBJECTS OF THE INVENTION

The primary object of this invention is to provide a method of rolling seamless tubes, for use in a continuous rolling mill having a restrained mandrel, in which the dead time which occurs at present in the performance of known techniques such as those described in detail above is substantially reduced, if not entirely removed, whereby to allow, other things being equal, a greater rate of production from the rolling mill.

Another object of the present invention is to provide apparatus for the performance of the above method.

SUMMARY OF THE INVENTION

The above stated objects of the invention are achieved according to the present invention, by a method of operating a continuous rolling mill having a plurality of successive roll stands, equipped with a mandrel-restraining crosspiece and a roller conveyor at the input of the rolling mill for the support and guidance of a mandrel/billet unit. The present invention comprising a mandrel having mounted thereon a pierced billet to be advanced between the rolls of the rolling mill for the production of seamless tubes, the improvement comprising the steps of: locking a first tail portion of said mandrel to a pusher member which is movable along the direction of the rolling axis of said rolling mill, from a first position to a second position along the length of said roller conveyor, advancing said mandrel/billet unit towards said rolling mill along said roller conveyor until said billet is at the input of the first roll stand of said rolling mill, locking a second tail portion of said mandrel, spaced from the said first portion, into a recess in said restraining crosspiece of said rolling mill, said recess extending parallel to said rolling axis, having transverse dimensions such as to permit the passage of said mandrel/billet unit therethrough, and having retractable locking means which are advanced to lock said second tail portion of said mandrel into said recess. Thereafter, said crosspiece is advanced along the direction of said rolling axis whereby to commence rolling said billet, and simultaneously said first tail portion of said mandrel is released from said pusher member, returning said pusher member to said first position thereof. A new mandrel/billet unit is then positioned on said roller conveyor after said restrained mandrel has moved therealong by a distance sufficient to leave room for said new mandrel/billet unit, said second tail portion of said mandrel is released from said crosspiece at the end of the rolling operation whereby said mandrel/billet unit, now rolled, passes from said rolling mill, and said crosspiece is returned to the initial position thereof, said crosspiece passing over said new mandrel/billet unit during its return movement without interference due to said recess in said crosspiece passing over said new mandrel/billet unit with said locking means being retracted.

The present invention also relates to an apparatus for the performance of the said method, which apparatus comprises, a continuous rolling mill having a plurality of aligned roll stands along a rolling axis, a roller conveyor at the input of said rolling mill for the support and guidance of a mandrel/billet unit comprising a mandrel having first and second tail portions, said second tail portion having a shoulder, and, mounted on said mandrel, a pierced billet to be advanced towards the first of said roll stands. A mandrel-restraining crosspiece is movable at a predetermined speed along the direction of said rolling axis, between an initial position and a final position thereof. The improvement comprises said mandrel-restraining crosspiece having an open ended elongate recess therein extending parallel to said rolling axis from front to back of said mandrel-restraining crosspiece, said recess having transverse dimensions such as to permit the passage therethrough of a mandrel/billet unit to be rolled on said rolling mill. A retractable positive mechanical stop means are provided on said mandrel-restraining crosspiece, said stop means being movable between an advanced position wherein they project into said recess to said shoulder formed on said second tail part of said mandrel of said mandrel/billet unit, and a retracted position wherein said recess is completely free and unobstructed. A lever system means is provided for controlling the advancing and retracting movement of said positive mechanical stop means into and from said recess, said lever systems being operated automatically by fixed abutments spaced along the path of movement of said mandrel-restraining crosspiece along said roller conveyor in correspondence with said initial and final positions between which said crosspiece is movable. Motor means are provided for controlling the displacement of said crosspiece, and a pusher member is movably guided on said roller conveyor parallel to the direction of said rolling axis from a first position spaced from the input of said rolling mill by a distance at least as great as the length of said mandrel, to a second position lying between said initial and final positions between which said mandrel-restraining crosspiece is displaceable. Means defining a recess in said pusher member for receiving said first tail end portion of said mandrel, means defining jaws in said recess of said pusher member for removably gripping said first tail end portion of said mandrel, and motor means are provided for displacing said pusher member between said first and second positions thereof.

Further characteristics and advantages of the invention will become apparent from the following detailed description of apparatus according to the invention, and of the method to be performed by this apparatus, which description will make reference to the attached drawings provided purely by way of non-limitative example.

DESCRIPTION OF THE PREFERRED EMBODIMENT

Figures 1, 2, 3, 4:
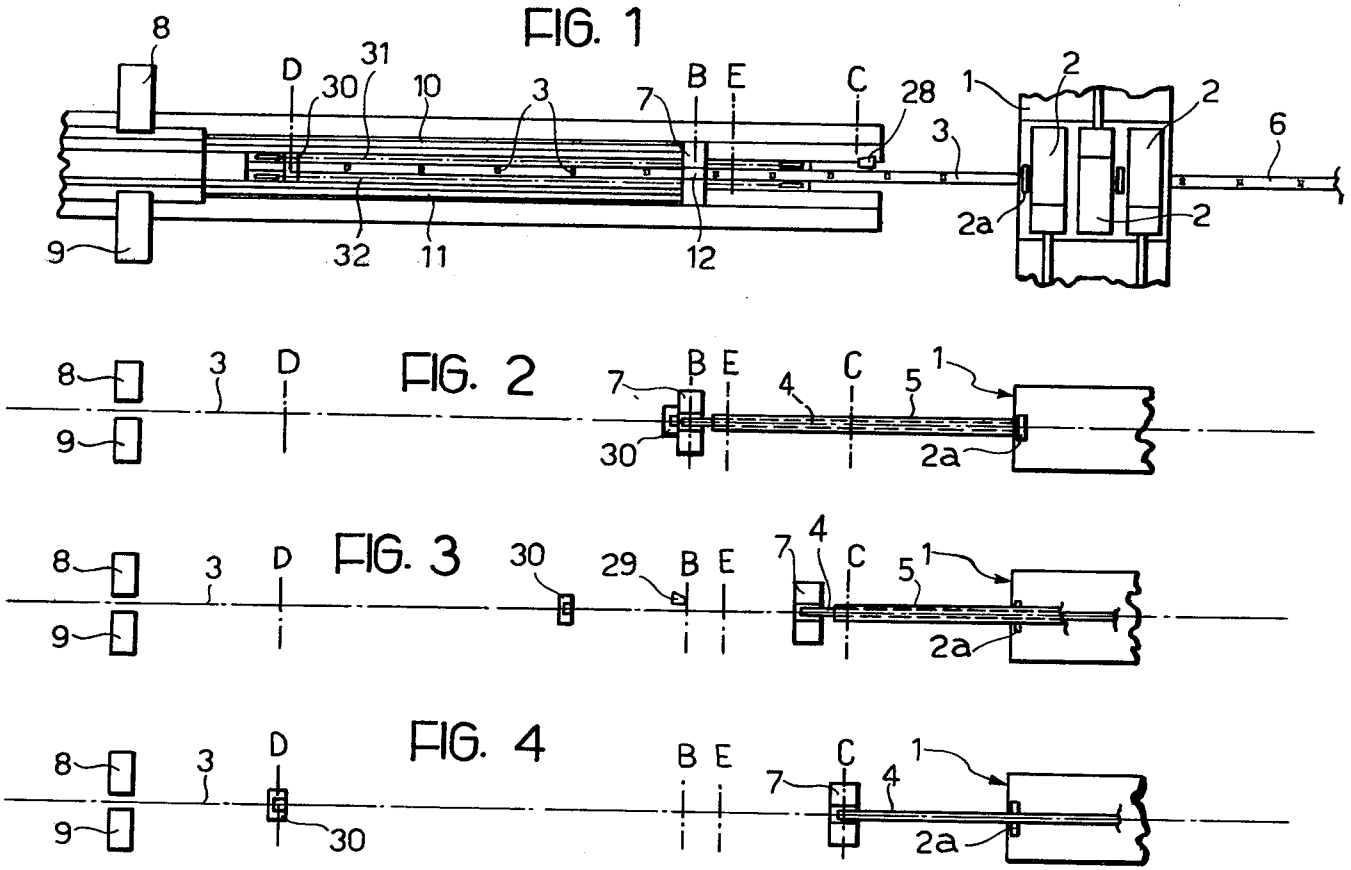
FIG. 1 is a schematic plan view of a part of a continuous rolling mill having a restrained mandrel and equipped with the novel apparatus of this invention for performing the novel method for rolling seamless tubes.
FIGS. 2, 3 and 4 are plan views similar to FIG. 1, but on a smaller scale, showing the apparatus in various phases during the performance of the method of this invention.

Referring now to the drawings there is schematically shown a rolling mill 1, including a plurality of roll stands 2 aligned along the rolling axis A of the mill, equipped with a roller conveyor 3 at the input of the mill, for the support and guidance of successive units each comprising a mandrel 4 and billet 5, which latter is to be subject to rolling. The rolling mill also has a roller conveyor 6 at its output end, and a restraining crosspiece 7 for the control of the movement of the mandrel 4 during the rolling of the workpiece 5. This crosspiece 7 is movably guided along a part of the rolling axis A between two positions B and C, spaced from the input 2*a* of the first roll stand 2 by respective predetermined distances which are determined in dependence on the length of the billet 5 to be rolled, and of the rolling speed.

The displacement of the crosspiece 7 is effected by means of motors, schematically indicated by numerals 8 and 9, to which the crosspiece is linked by attachment means including connections 10, 11 extending laterally of the crosspiece 7.

In the embodiment illustrated the motors 8 and 9 control respective racks (not shown because they are conventional) to which the crosspiece 7 is rigidly connected by means of the laterally extending connections 10, 11.

In the top of the crosspiece 7 there is formed a recess 12 of part-cylindrical form with its axis parallel to the rolling axis A and having transverse dimensions which are such as to allow a mandrel/billet unit to pass therethrough.

Figure 5:
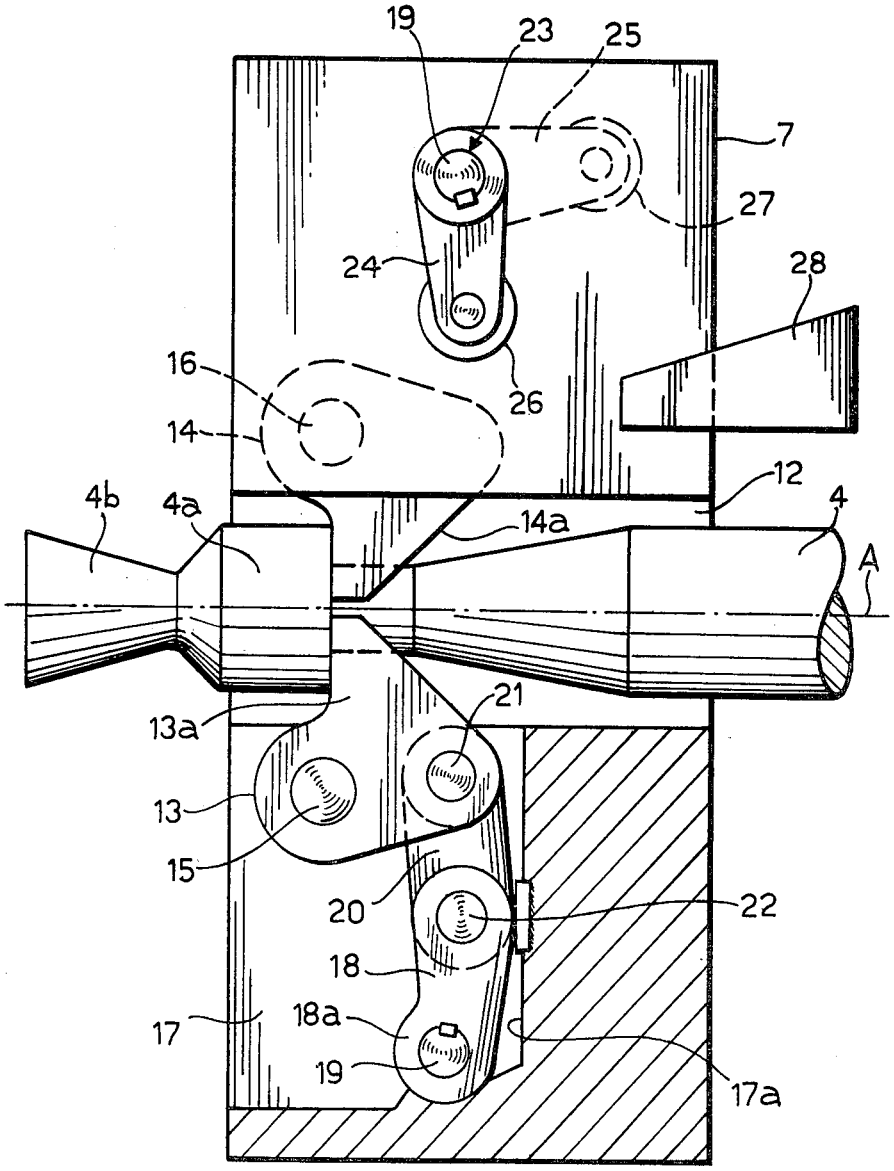
FIG. 5 shows, on an enlarged scale, and partly in section, a mandrel restraining crosspiece formed as part of the apparatus for performing the novel method of this invention.
Figure 6:
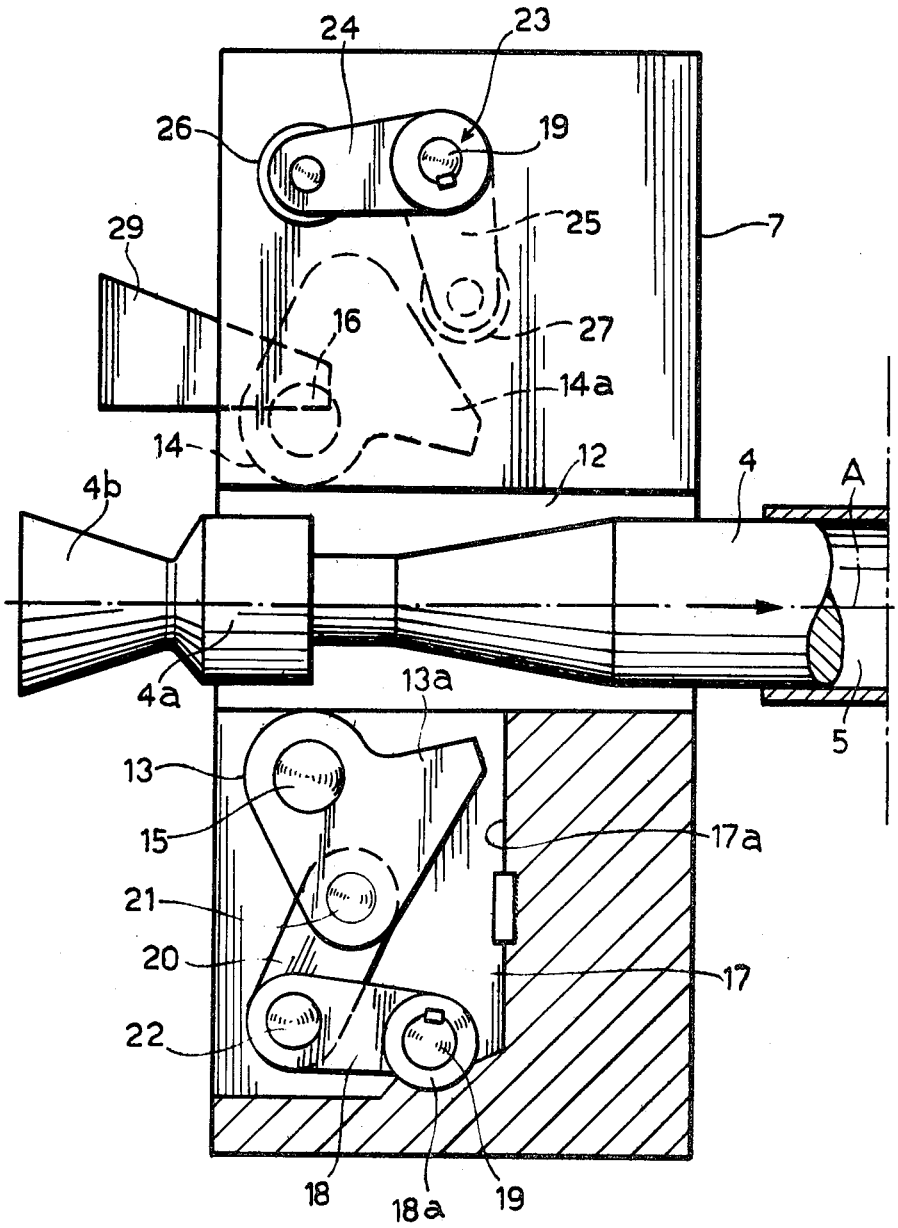
FIG. 6 shows the same crosspiece as in FIG. 5, in a different operating condition.

On either side of the recess 12, as can be seen in FIGS. 5 and 6, there are two pivoted abutment stops 13, 14 pivoted on respective vertical pins 15, 16 carried by the said crosspiece 7 in positions one on either side of the recess 12. The abutment stops 13, 14 have abutment arms 13*a*, 14*a* and are angularly displaceable, in a manner which will be described in more detail below, about the pins 15 and 16 from a position in which the respective abutment arms 13*a* and 14*a* are aligned and extending transversely into the recess 12 (as shown in FIG. 5) to a position in which the arms 13*a*, 14*a* are positioned laterally of and outside the said recess (as shown in FIG. 6). The said arms 13*a*, 14*a*, when extending transversely into the recess 12 form part of a positive mechanical abutment stop of the retractable type, intended to engage a cooperating shoulder part 4a at the rear of the mandrel 4 located in a position spaced a predetermined distance along the mandrel from the tail end thereof.

The angular displacement of the pivoted stops 13 and 14 is obtained by means of identical lever systems, and for simplicity the following description will describe in detail only the lever system associated with the stop 13, it being understood that the other lever system is identical.

The lever system to be described is located in a chamber 17 formed in the crosspiece 7 to one side of the recess 12 and opening into the said recess 12. This lever system includes lever 18 having one end 18a fixed onto a vertical shaft 19 rotatably supported by the said crosspiece 7 and projecting up through the upper wall of the crosspiece itself.

The other end of the lever 18 is connected by a pivot pin 22 to a link 20 which is pivotally connected by a pivot pin 21 to the pivoted stop 13, the pivot pin 21 being spaced from the pivot 15 about which the stop 13 turns.

When the stop 13 is in the position illustrated in FIG. 5 the axis of the pivot pin 21 and that of the shaft 19 lie in a vertical plane perpendicular to the rolling axis A, which coincides with the axis of the mandrel 4, while the axis of the pin 22 is located slightly forwardly with respect to this plane. It is to be noted, moreover, that in this position of the stop 13, the ends of the link 20 and the lever 18 which are pivotally connected together by the pivot pin 22 abut against the vertical front wall 17a of the chamber 17. The lever system controlling the position of the stop 13 thus acts as a toggle linkage which is in an over-center position when the stop 13 is advanced into the recess 12, thereby positively locking it in the advanced position.

On the upper end of the shaft 19, where it projects from the crosspiece 7, there is fixed a bell crank 23 the arms 24 and 25 of which carry at their free ends respective free rollers 26, 27. In the above discussed position of the stop 13 the bell crank 23 is positioned with its arm 24 generally perpendicular to the rolling axis A and extending towards the recess 12, and the arm 25 extending generally parallel to the rolling axis A and away from the rolling direction indicated by the arrow in FIG. 6.

This bell crank lever 23, which constitutes the control member for the lever system described above, is intended to cooperate with fixed abutments located in correspondence with the positions B and C, between which the crosspiece 7 is movable. In particular, near to the position C there is located a fixed abutment 28 (shown in FIG. 5) essentially in the form of a rectilinear cam, inclined to the rolling axis and diverging from the rolling axis A towards the input of the rolling mill; the inclined face 28a of the said cam 28 is located so as to lie in the path of the roller 26 when the bell crank lever 23 is in the position illustrated in FIG. 5.

Near to position B there is located a further fixed abutment 29 in the form of another rectilinear and inclined cam which, in this case, is convergent with the rolling axis A towards the input of the rolling mill. The inclined face 29a of the said cam lies in the path of the roller 27 when the bell crank 23 is in the position illustrated in FIG. 6.

Figure 7:
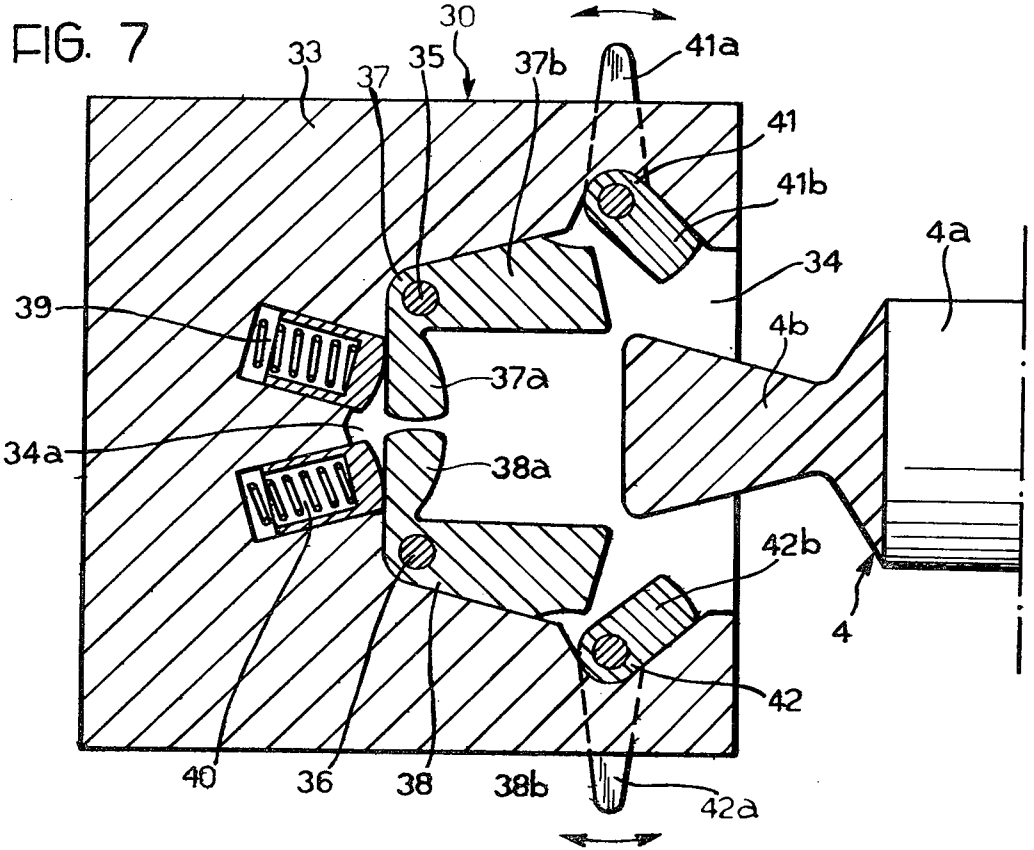
FIGS. 7 and 8 show, on a larger scale, and in section, a pusher member forming a part of the apparatus for performing the method of this invention, in respective different operating stages.
Figure 8:
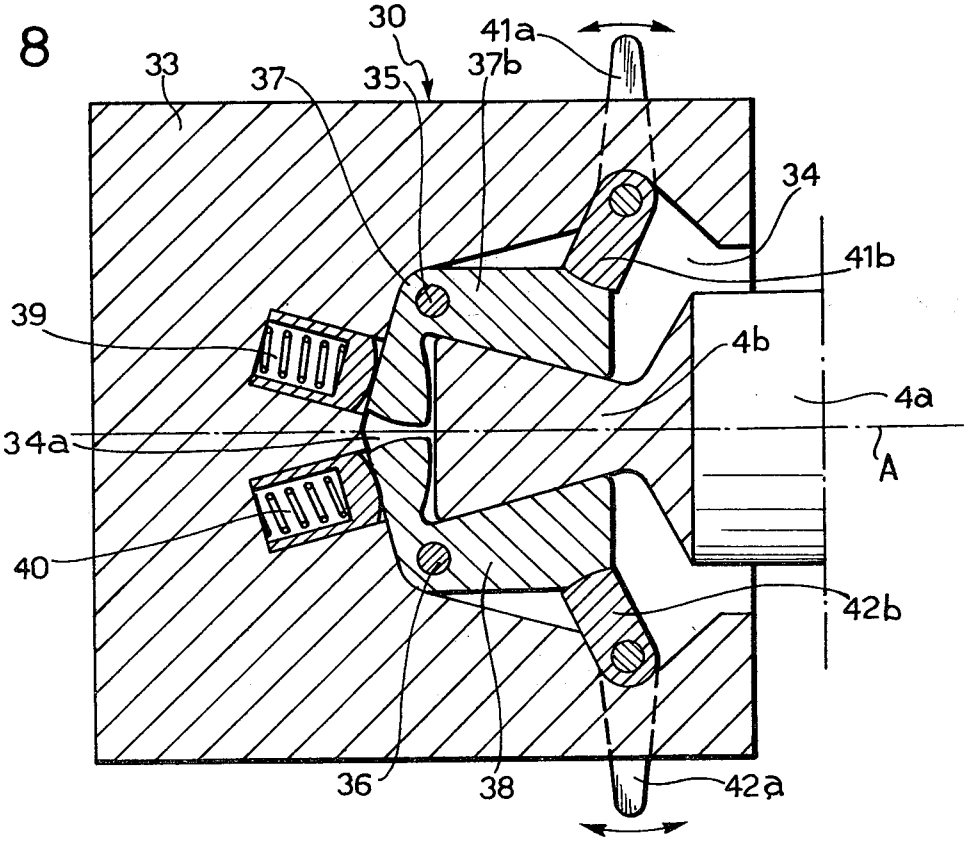

A pusher member, generally indicated by numeral 30, movably guided in a conventional manner (not shown) on the said roller conveyor 3 in the direction of the rolling axis is shown in FIGS. 7 and 8. This pusher member is laterally fixed by links (not shown) to respective opposite chains 31, 32 which are conventionally driven, and which move the pusher member itself from a position D, in which position it is shown in FIG. 1 (at the commencement of the cycle) spaced from the input of the rolling mill by a distance at least equal to the length of the mandrel 4, to a position E lying between the positions B and C between which the restraining crosspiece 7 is movable.

The pusher member 30 is essentially constituted by a body 33 in which is formed a blind bottomed recess 34 open towards the rolling mill and intended to receive, in a manner which will be described in more detail below, the tail end 4b of the mandrel 4 which is shaped as a frusto-conical tail to facilitate gripping as will be described below.

In particular, in the said recess 34, near to the bottom 34a thereof, there are fixed two vertical pins 35, 36, symmetrically disposed with respect to the longitudinal axis of the recess 34 which coincides with the rolling axis. On the said pins 35, 36 there are pivoted respective bell crank levers 37, 38, each of which has arms (37a, 37b and 38a, 38b respectively) angularly turnable through an angle less than 90°. The arms 37a, 38a are subjected to the action of respective precompressed springs 39, 40 which maintain the bell crank levers 37, 38 in the positions illustrated in FIG. 7. In this position, the arms 37b, 38b of the said bell crank levers extend generally parallel to the rolling axis and are spaced from one another by a distance greater than the greatest transverse dimension of the tail end 4b of the mandrel 4. It is to be noted that this tail end 4b is essentially frusto-conical in shape and has a length equal to, or slightly greater than the length of the arms 37b, 38b.

In the recess 34 there are further pivoted two bell crank levers 41, 42 each of which has an arm 41a, 42a extending laterally out beyond the sides of the body 33 which lie parallel to the rolling axis, and an arm 41b, 42b extending into the said recess 34 towards the rolling axis. The two arms of each bell crank lever are set at an obtuse angle with respect to one another. In the position shown in FIG. 7 the bell crank levers 41 and 42 are located with their respective arms 41b, 42b in positions spaced from the arms 37b, 38b of the levers 37, 38.

Along the roller conveyor 3, and in predetermined positions along it, there are located pairs of fixed abutments (not shown) which respectively engage with the arms 41a, 42a of the bell crank levers 41, 42. The said fixed abutments are intended to cause angular displacement of the levers 41, 42 about their respective pivots as the pusher 30 is moved therepast, such that the arms 41b, 42b of these bell crank levers become displaced from the position illustrated in FIG. 7 to the position illustrated in FIG. 8 in which they act as abutment stops preventing the arms 37b, 38b of the levers 37, 38 from turning to the positions shown in FIG. 7.

OPERATION

In an initial condition at the start of the operating cycle, the pusher member 30 is at rest in position D with the levers 37, 38 subjected only to the action of the springs 39, 40 and therefore in the position illustrated in FIG. 7. The crosspiece 7 is in the position B and the movable stops 13, 14 thereof are angularly displaced in such a way that the respective arms 13a, 14a are retracted from the recess 12. A prepared mandrel/billet unit is then loaded onto the roller conveyor 13 at a point between the pusher member 30 and the input of the rolling mill.

After this, by means of the chains 31, 32 the pusher member 30 is caused to advance at a predetermined speed until the swallow tail end 4*b* of the mandrel becomes located between the arms 37*b*, 38*b* of the levers 37, 38 of the pusher member 30. Further movement of the pusher member 30 causes the tail end 4*b* of the mandrel 4 to press against the arms 37*a*, 38*a* of the said levers, and to overcome the bias of the springs 39, 40 so that an angular displacement of the said levers about their respective pins 35 and 36 takes place. In this way the arms 37*b* and 38*b* are caused to grip the said tail end 4*b*.

After this gripping has taken place, the arms 41*a*, 42*a* of the levers 41, 42, moved by their respective fixed abutments, cause angular displacement of the levers 41, 42 from the position shown in FIG. 7 to the position shown in FIG. 8 where the arms 41*b*, 42*b* are located as abutment stops against the arms 37*b*, 38*b* of the levers 37, 38. The frusto-conical end 4*b* of the mandrel is thus automatically gripped between the levers 37, 38 of the pusher member 30 and locked onto the pusher member 30 which, drawn by the chains 31, 32, then causes the mandrel to advance towards the rolling mill.

Just as the billet 5 is about to enter between them the rolls of the first roll stand are started, as are the motors for advancing the crosspiece 7. As the crosspiece advances the inclined cams 28 cause the rollers 26 to be displaced away from the rolling axis A and the pins 19 are thus turned to displace the lever systems controlling the positions of the movable stops 13, 14 to the positions shown in FIG. 5. In this position the stops 13, 14 constitute a transverse positive mechanical abutment in the recess 12, against which the shoulder 4*a* of the mandrel 4 engages positively being pushed at a greater displacement speed than the crosspiece 7 by the pusher member 30.

When this engagement has been effected the rolling of the billet 5 by the rolls of the first roll stand commences and the end 4*b* of the mandrel is released from the pusher member 30. This release is permitted by annular displacement of the abutment stops 41*b*, 42*b* which were retaining the arms 37*b*, 38*b* of the levers 37, 38, which displacement results from disengagement of the arms 41*a*, 42*a* of the rocker levers 41, 42, from the respective fixed abutments (not shown) when the mandrel has been released the said pusher member 30 is stopped. While the billet is passing through the roll stands and is being subjected to the rolling operation, the pusher member 30 is rapidly returned to the position it occupied at the beginning of the cycle.

As the crosspiece 7 is just about to reach the position C (see FIG. 3), the cam abutments engage the rolls 26 of the bell crank 23, causing an angular displacement of the respective arms 18 in such a direction as to cause these to become spaced from the vertical walls 17*a* of the chamber 17 of the crosspiece 7. When, as a result of this angular displacement, the pivot pins 22 joining the links 20 and the arms 18 pass beyond the respective positions aligned (or coplaner) with the axes of the pins 21 and the shafts 19, the arms 13*a*, 14*a* of the stops 13, 14 are no longer able to resist the force exerted on them by the mandrel and these stops 13, 14 are thus angularly displaced about their respective pins 15, 16 into the open position shown in FIG. 6. The mandrel is thus automatically released from the crosspiece 7 and, consequently, the mandrel and the billet rolled on it are separated from the crosspiece 7 and carried out from the rolling mill. When the tail end 4*b* of the mandrel 4 has safely left the recess 12 of the crosspiece 7, the motors 8, 9 are controlled to cause the return of the crosspiece to the initial position (position B).

Before this, indeed as soon as the end 4*b* of the mandrel has left enough of the roller conveyor 3 free, there is positioned on it a new mandrel/billet unit. It is to be noted that such new mandrel/billet unit does not obstruct the return of the crosspiece 7 into its initial position because of the presence in the crosspiece of the recess 12 which is suitably dimensioned to allow the mandrel/billet unit to pass therethrough.

It is also to be noted that when the crosspiece 7, on its return path, is near to the position B, the cam abutments 29 cause the levers 13, 14 to turn into the positions illustrated in FIG. 6.

The description of the method and associated apparatus of this invention has been made with reference to the use of a previously formed mandrel/billet unit. However the same method and the same apparatus can with advantage be used even when the introduction of the mandrel into the associated billet takes place in the rolling line.

What is claimed is:

1. In a method of operating a continuous rolling mill having a plurality of successive roll stands, equipped with a mandrel-restraining crosspiece and a roller conveyor at the input of the rolling mill for the support and guidance of a mandrel/billet unit comprising a mandrel having mounted thereon a pierced billet to be advanced between the rolls of the rolling mill for the production of seamless tubes, the improvement comprising the steps of:

locking a first tail portion of said mandrel to a pusher member which is movable along the direction of the rolling axis of said rolling mill, from a first position to a second position along the length of said roller conveyor, advancing said mandrel/billet unit towards said rolling mill along said roller conveyor until said billet is at the input of the first roll stand of said rolling mill, locking a second tail portion of said mandrel, spaced from the said first portion, into a recess in said restraining crosspiece of said rolling mill, said recess extending parallel to said rolling axis, having transverse dimensions such as to permit the passage of said mandrel/billet unit therethrough, and having retractable locking means which are advanced to lock said second tail portion of said mandrel into said recess, advancing said crosspiece along the direction of said rolling axis whereby to commence rolling said billet, and simultaneously releasing said first tail portion of said mandrel from said pusher member, returning said pusher member to said first position thereof, positioning a new mandrel/billet unit on said roller conveyor after said restrained mandrel has moved therealong by a distance sufficient to leave room for said new mandrel/billet unit, releasing said second tail portion of said mandrel from said crosspiece at the end of the rolling operation whereby said mandrel/billet unit, now rolled, passes from said rolling mill, and returning said crosspiece to the initial position thereof, said crosspiece passing over said new mandrel/billet unit during its return movement without interference due to said recess in said crosspiece passing over said new mandrel/billet unit with said locking means being retracted.

2. In a continuous rolling mill having a plurality of aligned roll stands along a rolling axis, a roller conveyor at the input of said rolling mill for the support and guidance of a mandrel/billet unit comprising a mandrel having first and second tail portions, said second tail portion having a shoulder, and, mounted on said mandrel, a pierced billet to be advanced towards the first of said roll stands, and a mandrel-restraining crosspiece movable at a predetermined speed along the direction of said rolling axis, between an initial position and a final position thereof, the improvement wherein:

said mandrel-restraining crosspiece has an open ended elongate recess therein extending parallel to said rolling axis from front to back of said mandrel-restraining crosspiece, said recess having transverse dimensions such as to permit the passage therethrough of a mandrel/billet unit to be rolled on said rolling mill, means defining a retractable positive mechanical stop on said mandrel-restraining crosspiece, said stop means being movable between an advanced position wherein they project into said recess to said shoulder formed on said second tail part of said mandrel of said mandrel/billet unit, and a retracted position wherein said recess is completely free and unobstructed, lever system means for controlling the advancing and retracting movement of said positive mechanical stop means into and from said recess, said lever systems being operated automatically by fixed abutments spaced along the path of movement of said mandrel-restraining crosspiece along said roller conveyor in correspondence with said initial and final positions between which said crosspiece is movable, motor means for controlling the displacement of said crosspiece, a pusher member movably guided on said roller conveyor parallel to the direction of said rolling axis from a first position spaced from the input of said rolling mill by a distance at least as great as the length of said mandrel, to a second position lying between said initial and final positions between which said mandrel-restraining crosspiece is displacable, means defining a recess in said pusher member for receiving said first tail end portion of said mandrel, means defining jaws in said recess of said pusher member for removably gripping said first tail end portion of said mandrel, and motor means for displacing said pusher member between said first and second positions thereof.

3. The apparatus of claim 2, wherein said retractable positive mechanical stop means on said crosspiece includes two stop members pivoted on respective vertical pivot pins supported on said crosspiece on either side of said elongate recess therein, said pivoted stop members having respective arms and being angularly displacable about said pivot pins from an advanced position in which said respective arms thereof extend generally transversly of said rolling axis and in relative alignment with one another, each projecting into said recess, to a retracted position in which said arms extend generally parallel to said rolling axis on either side of said recess, the angular displacement of said pivoted stop members being controlled by fixed abutments via said respective lever systems.

4. The apparatus of claim 3, wherein said lever systems for actuation of said pivoted stop members are mounted on said crosspiece within a chamber formed therein.

5. The apparatus of claim 2, wherein said means defining jaws of said pusher member are constituted by respective gripper arms of two bell crank levers pivoted on respective pivot pins supported in said recess in symmetrical positions with respect to said rolling axis, said bell crank levers being angularly displacable about their respective pivot pins between a position in which their respective gripper arms extend parallel to the direction of said rolling axis, and are relatively spaced by a distance at least equal to the transverse dimension of said first tail end portion of mandrel, and a position in which said gripper arms are gripping said first tail end portion of said mandrel.

6. The apparatus of claim 5, wherein said pusher member is provided with abutment means angularly displacable about respective pivot pins between a position locking said gripper arms of said bell crank levers in the position thereof gripping said first tail end portion of said mandrel, and a position spaced from said arms, the angular displacement of said abutment means being controlled by fixed abutments along said roller conveyor at said first and second positions between which said pusher member is movable.

* * * * *